United States Patent [19]

Focke

[11] Patent Number: 4,646,508

[45] Date of Patent: Mar. 3, 1987

[54] APPARATUS FOR PRODUCING PACKS ESPECIALLY CIGARETTE STICKS

[75] Inventor: Heinz Focke, Verden, Fed. Rep. of Germany

[73] Assignee: Focke & Co., Fed. Rep. of Germany

[21] Appl. No.: 773,726

[22] Filed: Sep. 9, 1985

[30] Foreign Application Priority Data

Sep. 12, 1984 [DE] Fed. Rep. of Germany ..... 3433428

[51] Int. Cl.[4] ..... B65B 11/30

[52] U.S. Cl. ..... 53/234

[58] Field of Search ..... 53/234, 225

[56] References Cited

U.S. PATENT DOCUMENTS

| | | | |
|---|---|---|---|
| 546,193 | 9/1895 | Schilling | 53/234 |
| 645,016 | 3/1900 | Rose | 53/234 |
| 788,494 | 4/1905 | Placer | 53/234 |
| 990,532 | 4/1911 | Fischer | 53/234 |
| 1,351,025 | 8/1920 | Cooper | 53/234 |
| 1,359,181 | 11/1920 | Lietz | 53/234 X |
| 1,814,696 | 7/1931 | Hohl | 53/234 |
| 3,053,024 | 9/1962 | Wexler | 53/234 |
| 4,428,177 | 1/1984 | Focke | 53/234 X |
| 4,509,310 | 4/1985 | Focke | 53/234 X |

*Primary Examiner*—John Sipos

*Attorney, Agent, or Firm*—Sughrue, Mion, Zinn, Macpeak and Seas

[57] ABSTRACT

Apparatus for producing packs by wrapping articles in at least one blank, especially for producing large packs composed of pack groups (22), the pack groups (22) passing, to be wrapped in blanks, through at least one wrapping and folding member in the form of a folding turret (38 or 39) with several pockets (47 or 65) open in a radial direction, each for receiving one article or one pack group (22) together with a blank. In order to push the pack groups (22) out of the turret pockets (47 to 65) without tilting, each pocket has assigned to it a pushing-out device (96 or 97) movable in the radial direction and forming the bottom of the pocket.

2 Claims, 8 Drawing Figures

APPARATUS FOR PRODUCING PACKS ESPECIALLY CIGARETTE STICKS

DESCRIPTION

Figure 1:
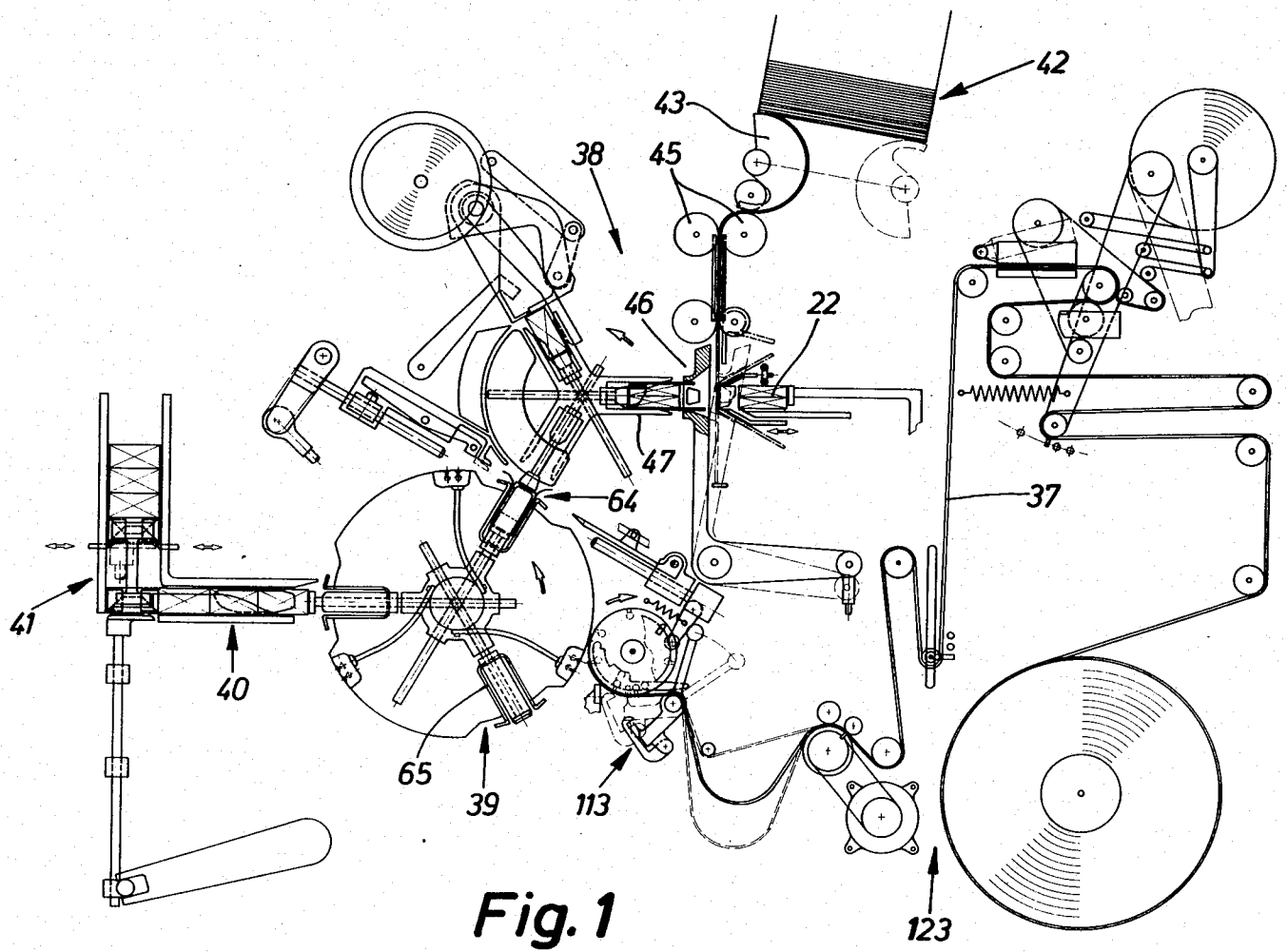

The invention relates to an apparatus for producing packs by wrapping articles in at least one blank, especially for producing large packs composed of pack groups (cigarette sticks each consisting of several cigarette packs).

The production of large packs composed of a group of smaller individual packs is practised in the cigarette industry during the production of so-called cigarette sticks. Cigarette sticks consist, for example, of ten cigarette packs wrapped in a common blank. This can consist of cardboard, paper or a foil. The construction of large packs of this type can be selected so that the pack group is wrapped in several blanks.

An apparatus for producing (large) packs, especially cigarette sticks, is described in German Offenlegungsschrift No. 3,123,496. In this proposal, the pack group is wrapped either in a paper blank, a foil blank, or both of these abovementioned blanks. Depending on the design of the pack, the pack group passes through one or two folding turrets, in the region of which blanks can be supplied and folding carried out. The large pack provided with one or more blanks leaves the apparatus in the region of a first folding turret or in the region of the second folding turret, depending on the design of the pack.

The object now to be achieved is to remove the elongate articles, for example large packs of the type mentioned, from the pockets of the folding turret or turrets without difficulty, that is to say without tilting them and without the damage caused thereby.

According to the invention, the elongate articles are grasped over their entire length in the turret pockets and pushed out by the pushing-out devices according to the invention. Tilting of the articles, which would be possible if the pushing-out devices engaged laterally into the pockets, can be safely avoided as a result of the invention. The invention is particularly advantageous for the product of cigarette sticks, that is to say when several individual articles, in particular cigarette packs, are arranged in a row next to one another. The individual articles or cigarette packs can no longer be offset out of line because of being subjected to uneven pressure when pushed out of the turret pockets.

Preferred constructive details of the invention are described in more detail below. However, the construction, by means of which a tilt-free mounting of the pushing-out devices is guaranteed, is extremely advantageous.

The invention is preferably used on an apparatus according to German Offenlegungsschrift No. 3,123,496, corresponding to U.S. Pat. No. 4,509,310, specifically on both folding turrets with mutually coordinated movements of the pushing-out devices assigned to the two turrets or turret pockets.

Figure 2:
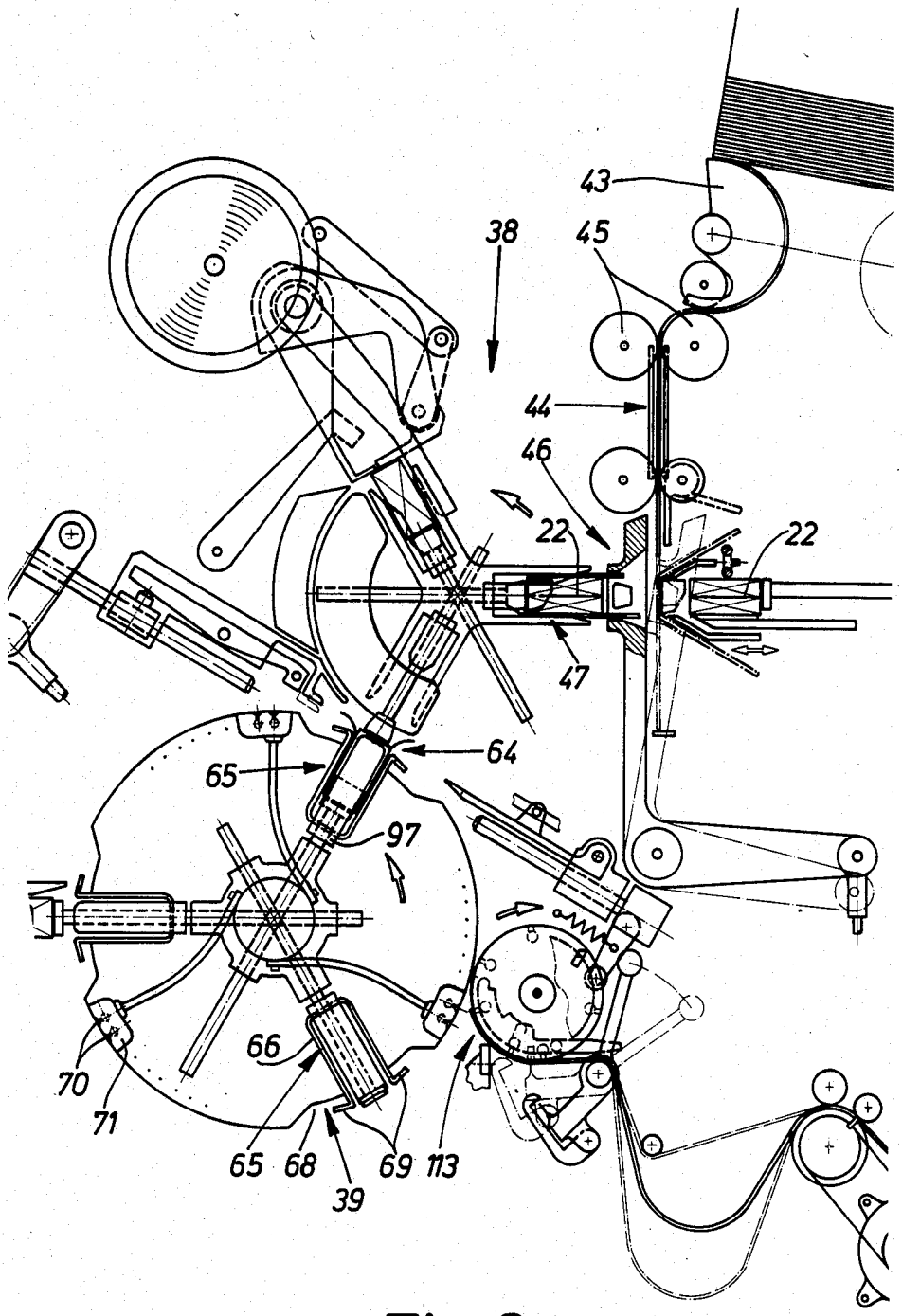
Figure 3:
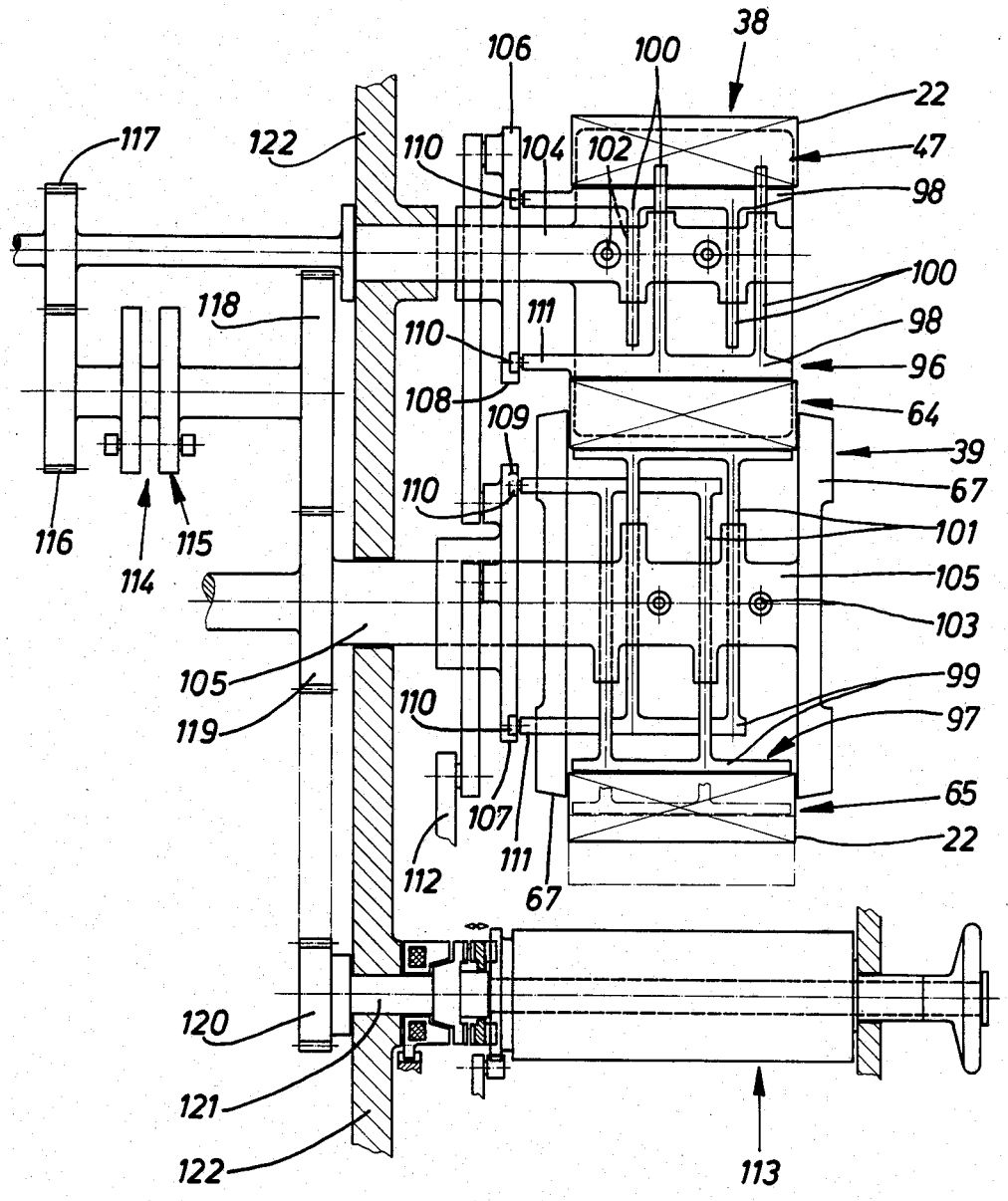
Figure 4:
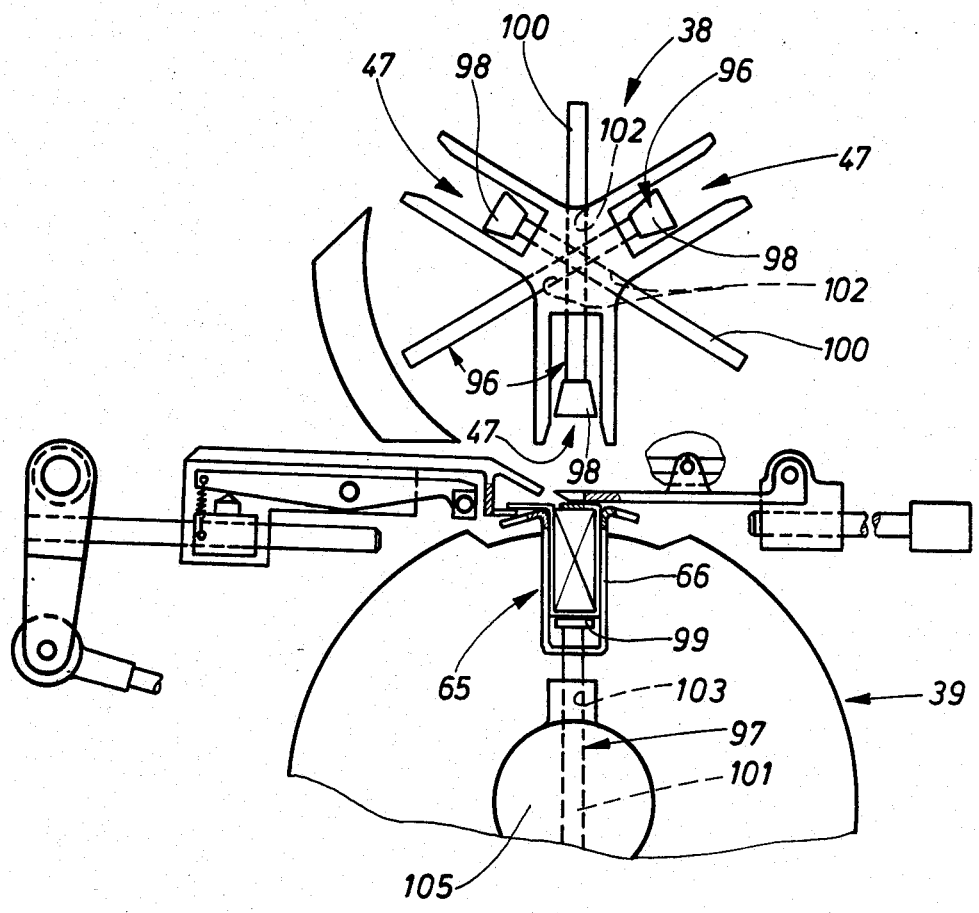
Figure 5:
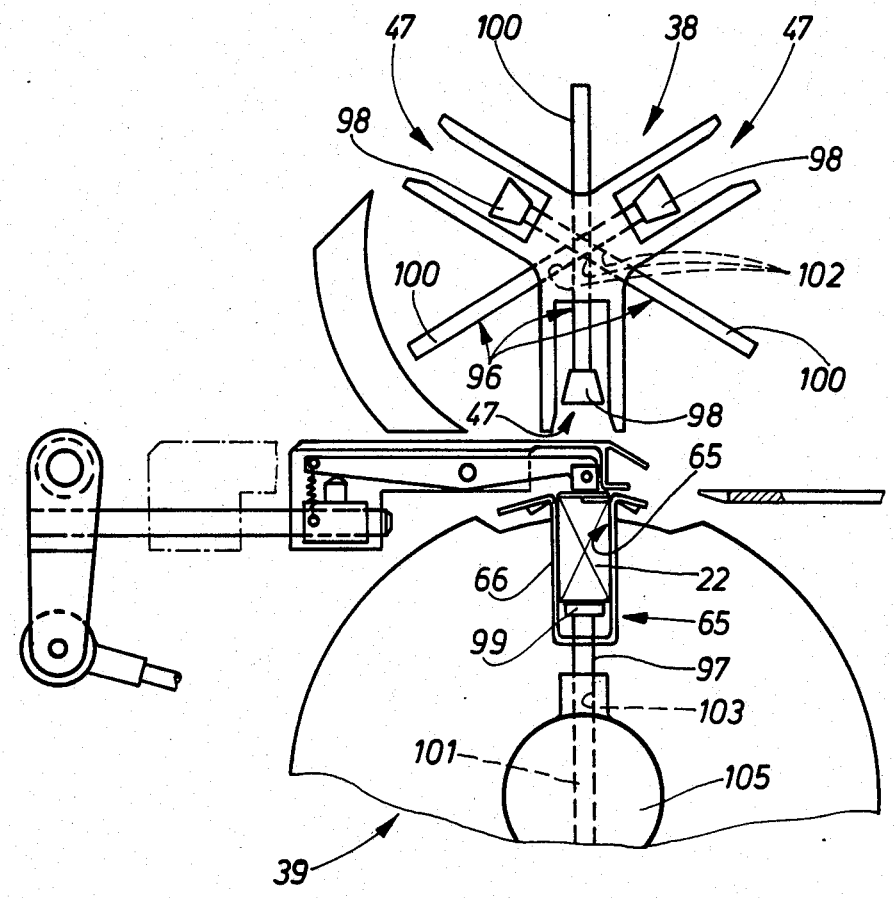
Figure 6:
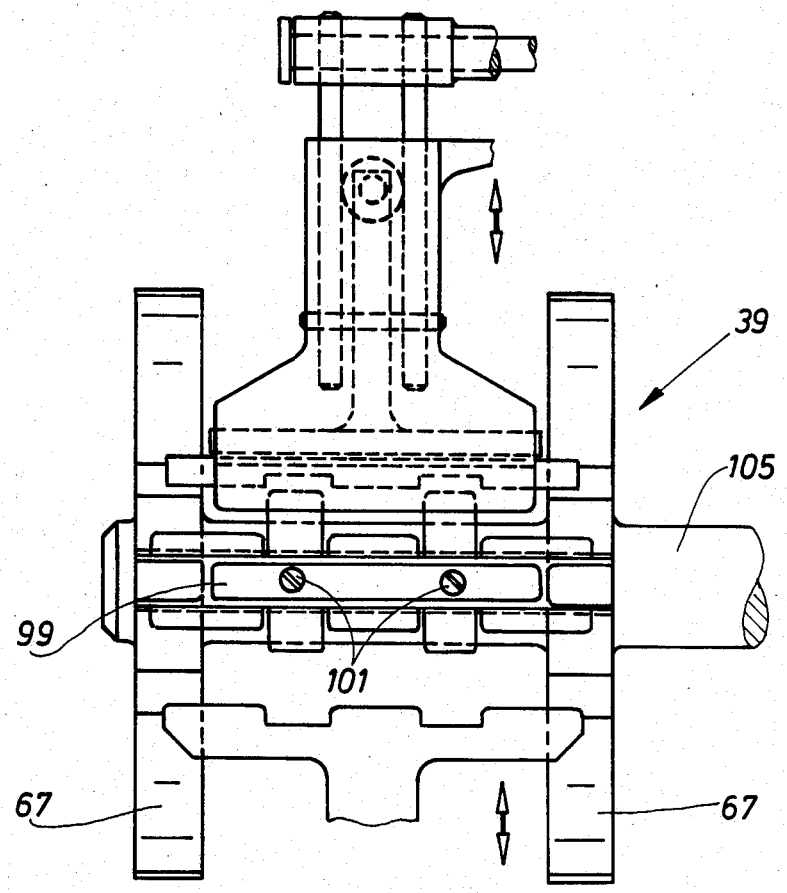
Figure 7:
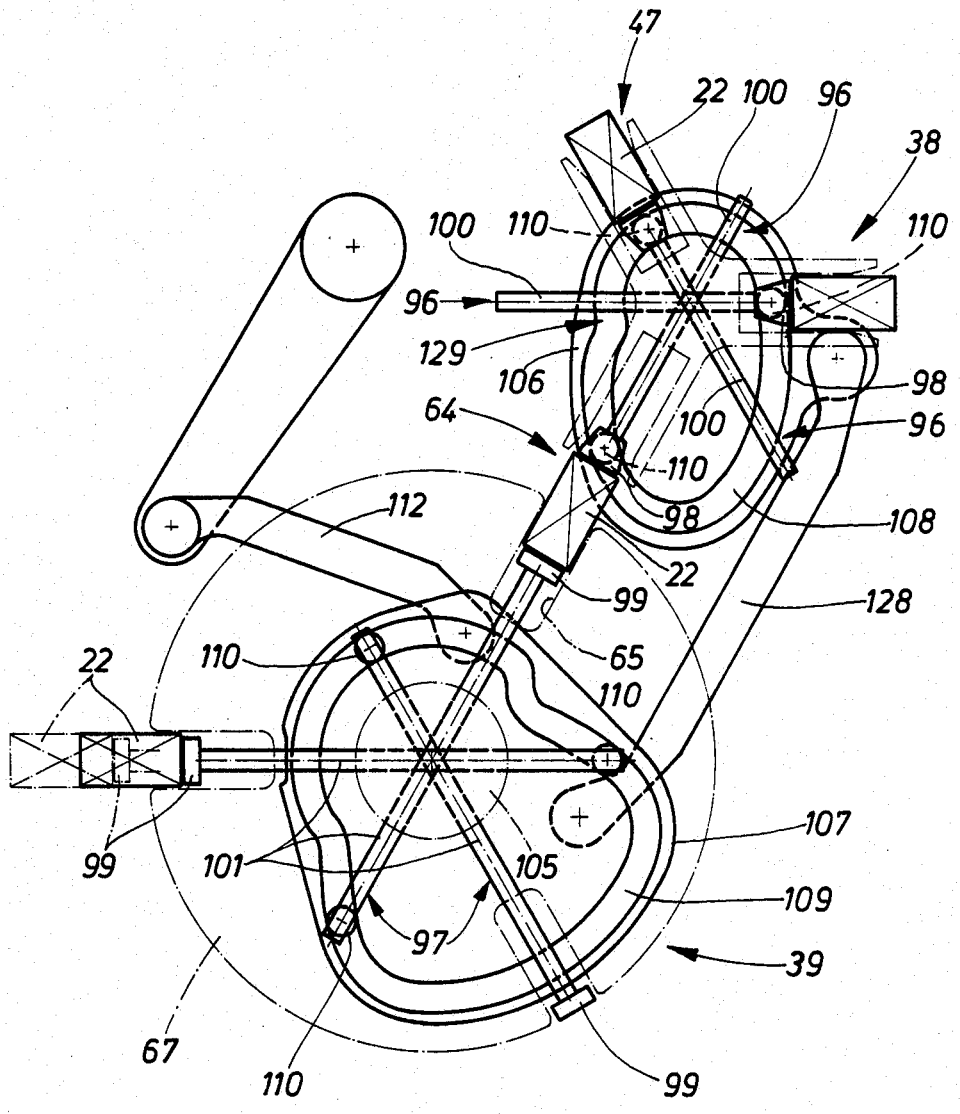
Figure 8:
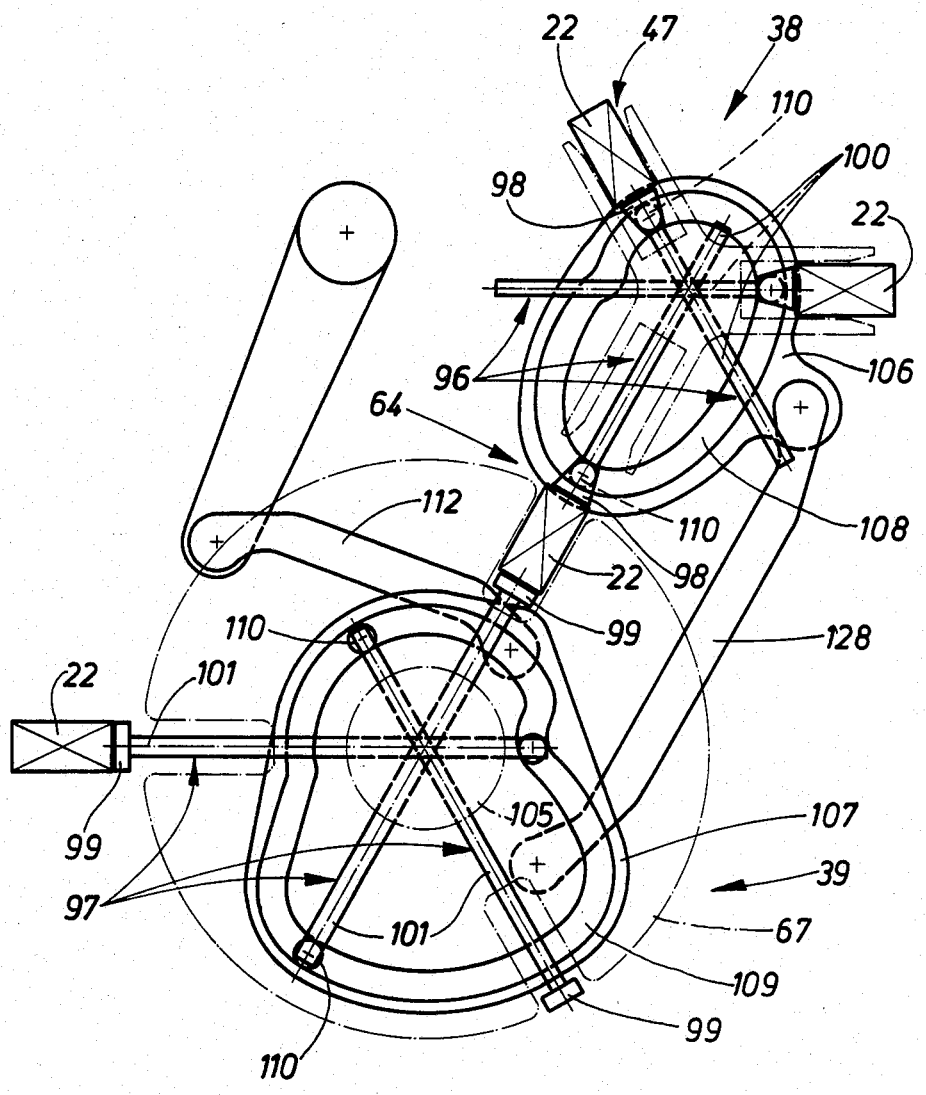

An exemplary embodiment of the invention is explained in more detail below with reference to the drawings. In the drawings:

FIG. 1 shows, in a diagrammatic side view, an entire apparatus for producing packs by wrapping articles in two blanks, FIG. 2 shows, again in a side view, on an enlarged scale a detail of the apparatus according to FIG. 1 with a first and a second folding turret, FIG. 3 shows a vertical or radial section through the folding turret according to FIG. 1, FIG. 4 shows, in a side view, details of the folding turrets, especially of the second folding turret, in a folding position, FIG. 5 shows a representation corresponding to that of FIG. 8, with the position of the folding members changed, FIG. 6 shows a plan view of the detail according to FIGS. 4 and 5, FIG. 7 shows, in a diagrammatic side view, the control mechanism for the pushing-out devices assigned to the turret pockets, in a first position, and FIG. 8 shows the mechanism according to FIG. 7 in a second movement position.

The present exemplary embodiment relates, above all, to the production of larger packs composed of several individual smaller packs, especially cigarette packs, combined into a pack group 22 and leaving the apparatus as cigarette sticks. The pack group 22 can be wrapped either in a cardboard blank and/or a foil blank or a paper blank. An example of a cardboard blank (not shown) consists of individual surface regions for forming an upper wall, a lower wall, side walls and a tubular tab. Lateral closing tabs are located in the region of the lower wall and side walls. A foil blank can be composed in a similar way, in particular likewise with an upper wall, a lower wall, a first longitudinal side wall arranged between them and two tubular tabs at the edges for forming the opposite longitudinal side wall. All the projecting parts of the blank are provided laterally with end tabs for forming end walls. The cardboard blank is preferably prefabricated, in particular prestamped, whilst the foil blank is severed from a continuous foil sheet 37. According to practical requirements, the pack group 22 is wrapped in one or both of the blanks mentioned.

In either case, that is to say irrespective of the number and type of blanks, the pack group 22 passes through a first folding turret 38 and then a second folding turret 39. The packs are pushed out of the latter in a radial direction and brought into an essentially horizontal discharge conveyor track 40. This is followed, in turn, by a vertical pack tower 41, into which the finished packs are pushed from below.

A blank-magazine 42 for receiving a stock of cardboard blanks is assigned to the first folding turret 38. Each time, a cardboard blank is extracted on the underside of the blank-magazine 42 by a rolling-off device 43 of known design and is introduced into a vertical blank-track 44. The cardboard blank is conveyed in a vertical plane in front of a mouthpiece 46 by transport rollers 45 in the region of the blank-track 44. The mouthpiece 46 is arranged in front of the first folding turret 38, in such a way that the pack group 22 can be introduced in a horizontal plane through the mouthpiece 46 into a pocket 47 of the folding turret 38. When the pack group 22 is pushed into the pocket 47, the cardboard blank is carried with it and wrapped in the form of a U round the pack group 22. When the pack group is pushed into a turret pocket and during transport along the conveying path predetermined by the turret, the cardboard blank is folded and the pack group wrapped in the latter in a way known per se by means of folding members which are assigned to the folding turret 38 and which need not be described in any more detail here. The folding turret 38 is moved periodically in the same way as the subsequent folding turret 39.

In the region of a transfer station 64, the pack or pack group 22 so far produced is ejected from the pocket 47 of the first folding turret 38 and at the same time introduced into an adjacent pocket 65 of the second folding turret 39.

The folding turret 39 also, like the folding turret 38, is equipped with three pockets 65 arranged at equal peripheral distances from one another. These consist of a pocket lining 66 of U-shaped cross-section, for example made of sheet metal. On the radially outer side, the pockets 65 project or the pocket lining 66 projects beyond the profile of the turret. A turret body consisting of lateral turret discs 67 is provided, in the region of the pockets 65, with radial recesses 68. The pocket linings 66 extend within the latter. Their free edge is provided with a supporting leg 69 angled in the peripheral direction. These are arranged at an acute angle relative to the pocket lining 66, that is to say bent radially inwards to a slight extent. The supporting legs serve to receive blank parts, in particular the tubular tabs of a foil blank supplied to the second folding turret 39, during the time when the foil blank is in an intermediate position. The pocket lining 66 extends over the entire width of the folding turret 39 and consequently connects the turret discs 67 to one another. To wrap the pack group 22 in a foil blank, the latter is laid against the outer periphery of the folding turret 39, specifically in such a way that the foil blank lies approximately centrally in relation to the particular pocket 65. At the same time, the foil blank is grasped (only) in a region located at the front of the direction of rotation of the folding turret 39 and is fixed by means of suction air. For this purpose, the folding turret 39 is provided at suitable locations with suction bores 70 on the outer periphery. When the folding turret or turret body is designed with two lateral turret discs 67, the suction bores 70 in the two turret discs 67 are arranged in inserts 71 located opposite one another. The foil blank is consequently grasped only in front side regions on the folding turret 39 and is therefore held free of constraint and free of creases. The suction bores 70 are connected in a suitable way to a central vacuum source via suction lines.

The pack group 22 or the already previously attached cardboard blank is wrapped in the foil blank in a way which is known in principle. When the pack group 22 is introduced into the pocket 65 in the region of the transverse station 64, the foil blank held ready on the outer periphery of the folding turret 39 is carried along and at the same time wraps the pack group 22 in the form of a U. The blank parts projecting beyond the pocket 65 are then laid against the pack group by suitable folding members. The blank parts folded over one another are welded or sealed to one another in a way known per se.

The folding turrets 38, 39 are designed and driven in a particular way. In both cases, radially movable pushing-out devices 96 and 97 are provided in the region of the pockets 47 and 65. In the initial position retracted inwards, these pushing-out devices 96, 97 or a transverse strip 98, 99 of the latter form the radially inner bottom of the pockets 47 and 65. The transverse strip 98, 99 is attached to (two) guide rods 100 or 101 which are mounted displaceably and supported in radial guide bores 102, 103 in a turret shaft 104, 105. The controlled movement of the pushing-out devices 96, 97, especially for pushing packs or pack groups out of the associated pockets, is executed by means of control discs 106, 107 assigned to each folding turret 38, 39 (see especially FIGS. 7 and 8). Control rollers 110 connected to the pushing-out devices 96 and 97 or the transverse strips 98, 99 of the latter via an extension 111 run in curved grooves 108, 109 of these control discs 106, 107. The control discs 106, 107 are driven to rotate, specifically when the folding turrets 38, 39 are stationary. By means of the rotary movement of the control discs 106, 107 and as a result of an appropriate shaping of the curved grooves 108, 109, the pushing-out devices 96, 97 are moved in one direction or the other when the folding turrets 38, 39 are stationary. The two control discs 106, 107 are connected to one another in transmission terms by means of a link 128. The rotary movement of the two control discs 106, 107 is executed by means of a link 112 attached to the control disc 107 and connected operatively to a central drive (not shown).

As can be seen very clearly in FIGS. 7 and 8, the movements of the pushing-out devices 96, 97 of the two folding turrets 38, 39 are coordinated with one another, so that in the region of the transverse station 64 the pack group 22, held free of play between the pushing-out devices 96, 97, facing one another, of the two folding turrets 38, 39, can be transferred out of the pocket 47 of the first folding turret 38 into the opposite pocket 65 of the second folding turret 39. The curved groove 108 of the control disc 106 assigned to the first folding turret 38 is in the form of an ellipse with a depression 129. The curved groove 109 of the control disc 107 assigned to the second folding turret 39 has approximately the contour of a keyhole.

The folding turrets 38, 39 and a cutting roller 113 assigned to the second folding turret 39 and intended for severing foil blanks from the foil sheet 37 are driven synchronously and at the same peripheral speeds by means of a common transmission. A stepping transmission 114 of suitable known design is provided for the periodic drive. FIG. 3 illustrates a star wheel 115 as an output member of the stepping transmission 114. The turret shaft 104 of the folding turret 38 is driven via gear wheels 116, 117. The turret shaft 105 of the folding turret 39 is driven via further gear wheels 118, 119, starting from the star wheel 115. The gear wheel 119 is connected in transmission terms to a gear wheel 120 for the rotary drive of the cutting roller 113. The turret shafts 104, 105 and a shaft piece 121 assigned to the cutting roller 113 are mounted rotatably in a common machine wall 122.

A supply device 123 for the foil sheet 37 is also assigned to the unit consisting of the folding turret 39 and cutting roller 113. The folding turret 39 and the cutting roller 113, the periphery of which is adjacent to the periphery of the aforementioned folding turret, constitute a drive unit, the movement of which is synchronised with that of the supply device 123. Each time, a portion of the foil sheet 37 corresponding to the length or width (in the direction of transport) of the foil blank required for wrapping the pack group 22 is delivered by the supply device 123. Since the present invention is not intended to relate to the design of the supply device 123 or that of the units preceding it, there is no need for a more detailed description of these parts of the apparatus.

In conclusion, the construction according to the invention is particularly advantageous for removing elongate articles, for example cigarette sticks, from pockets of folding turrets of a packaging machine. By means of the pushing-out devices 96, 98 and 97, 99 according to the invention, the elongate articles are grasped and pushed out over their entire length, preferably on the narrow side face, in the pockets 47 or 65 of the folding turrets 38 or 39. There is no possibility that the individual articles or cigarette packs will be subjected to uneven pressure and consequently offset out of line when the pack group 22 is pushed out of the pockets.

Finally, it should also be pointed out that the lateral discs 67 of the folding turret 39 serve at the same time for the lateral limitation of the turret pockets 65. The turret pockets 65 are therefore made open towards the outside in the radial direction only.

Furthermore, it should be stated again at this juncture that the invention can be used for an apparatus either with one folding turret or with several folding turrets of the type mentioned.

I claim:

1. Apparatus for producing elongated packs by wrapping a plurality of side-by-side articles in at least one blank, comprising:

at least a first rotatable, generally cylindrical, blank-folding turret (38 or 39), having a shaft (104 or 105) and an axis of rotation, for wrapping the articles with a blank;

said folding turret having a plurality of pockets (47 or 65), each opening only in the radial direction for receiving a blank and a plurality of said articles;

the length of each pocket extending in a direction parallel to said axis;

each pocket containing a radially movable ejector means (96 or 97) for forming the bottom of the pocket and for ejecting a wrapped pack from the pocket (47 or 65);

each ejector means having a driven end and a free end which has a support plate (98 or 99) axially extending over the entire said length of the turret pocket (47 or 65) and parallel to said axis of said turret;

at least a first rotatable control disc means (106 or 107) for controlling the radial movement of the ejector means in the pockets;

said control disc means (106 or 107) having a planar surface containing an irregularly curved groove (108 or 109);

an axially extending projection on the driven end of each ejector means; and control rollers (110) mounted on the projections of respective ejector means and running in the curved groove (108 or 109);

each ejector means (96 or 97) comprising two parallel guide rods (100 and 101) radially extending between said driven end and said free end;

said guide rods passing through a pair of respective radial guide bore holes (102 and 103) extending through said shaft (104 or 105), said guide bore holes supporting said guide rods for radial displacement in response to rotation of said control disc means; and further comprising:

a second said control disc means (107); and a second said folding turret having an axis of rotation parallel to, and spaced from, said axis of said first turret such that, when pockets of the two turrets are radially aligned and facing each other, said ejector means in the pocket (47) of said first turret is moved radially outward to eject said pack (22) from the first folding turret (38) and to transfer it directly into a pocket (65) of the second folding turret (39), if appropriate at the same time being wrapped in a blank; said first and second control disc means, during the transfer from the pocket (47) of the first folding turret (38) into the facing pocket (65) of the second folding turret (39), controlling the radial movement of the respective ejector means such that the wrapped pack is retained between said respective ejector means (96, 97) of the facing and radially aligned pockets; and further comprising:

a motion-transmitting link (128) interconnecting said first and second control disc means; and further comprising:

central drive means, engaging only said first control disc means (107), for producing rotation of said first control disc means and, through said motion-transmitting link, producing rotation of said second control disc means only when the two folding turrets (38, 39) are stationary.

2. Apparatus according to claim 1 in which said curved groove forms a closed loop.

* * * * *